US007383606B2

(12) United States Patent
Barker et al.

(10) Patent No.: US 7,383,606 B2
(45) Date of Patent: Jun. 10, 2008

(54) VACUUM CLEANER

(75) Inventors: David Barker, Prudhoe (GB); Barry Pears, Langley Moor (GB); Martyn Riley, Jesmond (GB)

(73) Assignee: Black & Decker Inc., Newark, DE (US)

( * ) Notice: Subject to any disclaimer, the term of this patent is extended or adjusted under 35 U.S.C. 154(b) by 600 days.

(21) Appl. No.: 10/876,825

(22) Filed: Jun. 25, 2004

(65) Prior Publication Data

US 2005/0022334 A1 Feb. 3, 2005

(30) Foreign Application Priority Data

Jun. 26, 2003 (GB) ..... 0314930.9
Jul. 29, 2003 (GB) ..... 0317674.0

(51) Int. Cl.
*A47L 5/00* (2006.01)

(52) U.S. Cl. ..... 15/327.1; 15/412; 15/413

(58) Field of Classification Search ..... None
See application file for complete search history.

(56) References Cited

FOREIGN PATENT DOCUMENTS

GB 2 384 972 A 8/2003

*Primary Examiner*—David A Redding
(74) *Attorney, Agent, or Firm*—John Yun; Bruce S. Shapiro; Wesley Muller

(57) ABSTRACT

A vacuum cleaner 2 having a housing 4 having an inlet 12 and an outlet 54 is disclosed. Actuation of a motor 46 causes a fan to displace air out of outlet 54, and the resulting suction upstream of the fan draws dirty air through inlet 12 and inwardly through walls of filter unit 22. Air from filter unit 22 passes along a duct to the motor 46 and fan. The housing 4 is formed from a first housing part defining a recess 36, and the recess is then closed by means of a closure member 56 to define the duct between the filter unit 22 and the motor 46.

7 Claims, 15 Drawing Sheets

VACUUM CLEANER

The present invention relates to vacuum cleaners, and relates particularly, but not exclusively, to cylinder type vacuum cleaners.

In conventional cylinder type vacuum cleaners, a motor arranged in a housing of the vacuum cleaner drives a fan, which causes air to be displaced radially outwards of the fan and expelled through vents in the housing. This in turn causes suction upstream of the fan, which draws dirty air into the vacuum cleaner housing, through a suitable filter such as a rigid filter unit or a flexible filter bag, the filter being located between an inlet of the housing and the fan. As a result, dirty air is drawn along a suitable accessory such as a flexible hose connected to the housing inlet, enters the inlet and passes through the filter, and cleaner air passes through the fan and is expelled through the vents in the housing.

A vacuum cleaner of this type is disclosed in WO 02/43553, in which a housing is formed from three parts, a tank element, a middle chassis element, and a top cover element, and a fan causes dirty air to be drawn into the housing and through a duct adjacent the base of the housing between the filter and an inlet to the fan. Vacuum cleaners of this type suffer from the drawback that formation of the duct adjacent the base of the housing is a difficult procedure if the housing is to be injection moulded from plastics material, and moulds for forming the housing requires a large number of complicated components, as a result of which the housing becomes very costly to make, and/or it is difficult to provide an injection moulded housing with sufficient rigidity and strength for use as vacuum cleaners.

Preferred embodiments of the present invention seek to overcome the above disadvantages of the prior art.

According to an aspect of the present invention, there is provided a housing for a vacuum cleaner, the housing comprising:

(i) a first housing part defining:

a first chamber having at least one first inlet for intake of air and at least one first outlet for exhaust of air, wherein said first chamber is adapted to accommodate filter means for removing particles larger than a predetermined size from air flowing from at least one said first inlet to at least one said first outlet;

a second chamber having at least one second inlet for intake of air and at least one second outlet for exhaust of air, wherein said second chamber is adapted to accommodate suction means for causing air to flow from at least one said first inlet to at least one said second outlet; and at least one recess formed in an external wall of said first housing part and connecting at least one said first outlet to at least one said second inlet; and (ii) at least one second housing part for closing the or each said recess to define at least one duct for directing air exhausted from the or each said first outlet to at least one said second inlet.

By providing at least one recess, connecting the or each first outlet with at least one second inlet, in an external wall of the first housing part, and by closing the recess by means of one or more second housing parts to define a duct directing air from the or each first outlet to at least one second inlet, this provides the advantage of simplifying injection moulding of the housing compared with prior art arrangements, thus reducing the cost of manufacture of a vacuum cleaner incorporating the housing. In addition, the housing can be injection moulded with the required strength and rigidity.

At least one said second housing part may comprise valve means for allowing intake of air from the atmosphere into said duct if the pressure difference between said duct and the atmosphere exceeds a predetermined level.

This provides the advantage of allowing bypass airflow, to prevent overheating of the vacuum cleaner motor if an inlet or a filter of the vacuum cleaner should become blocked or restricted.

The first housing part may further define a trough surrounding at least one said first outlet.

This provides the advantage of minimising the extent to which dirt falls into the duct when a filter is removed from the housing.

In a preferred embodiment, the cross-sectional area of the duct in a direction transverse to the direction of airflow is greater than the total cross-sectional area of the or each said second inlet.

This provides the advantage of minimising turbulence in airflow through the duct.

The housing may further comprise sealing means for sealing between the periphery of the or each said recess and the or each said second housing part.

The housing may further comprise restriction means for restricting access to at least one said second inlet.

This provides the advantage of preventing entry of dirt into the motor.

Said restriction means may comprise at least one grille.

According to another aspect of the present invention, there is provided a vacuum cleaner comprising:

a housing as defined above;

filter means arranged in said first chamber for removing particles larger than a predetermined size from air flowing from at least one said first inlet to at least one said first outlet; and suction means arranged in said second chamber for causing air to flow from at least one said first inlet to at least one said second outlet.

A preferred embodiment of the invention will now be described, by way of example only and not in any limitative sense, with reference to the accompanying drawings, in which.

Figure 1:
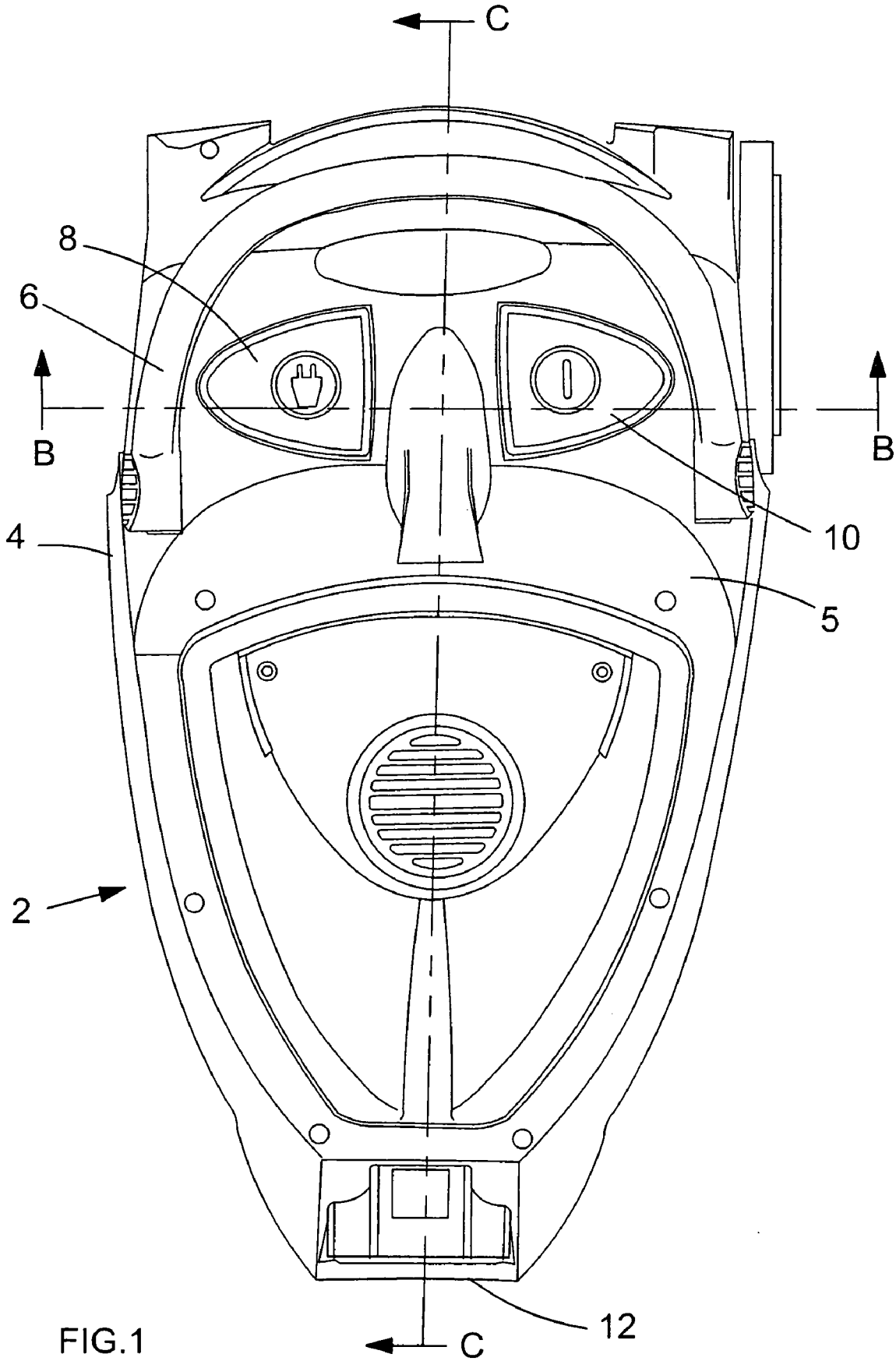
FIG. 1 is a plan view of a vacuum cleaner embodying the present invention.
Figure 2:
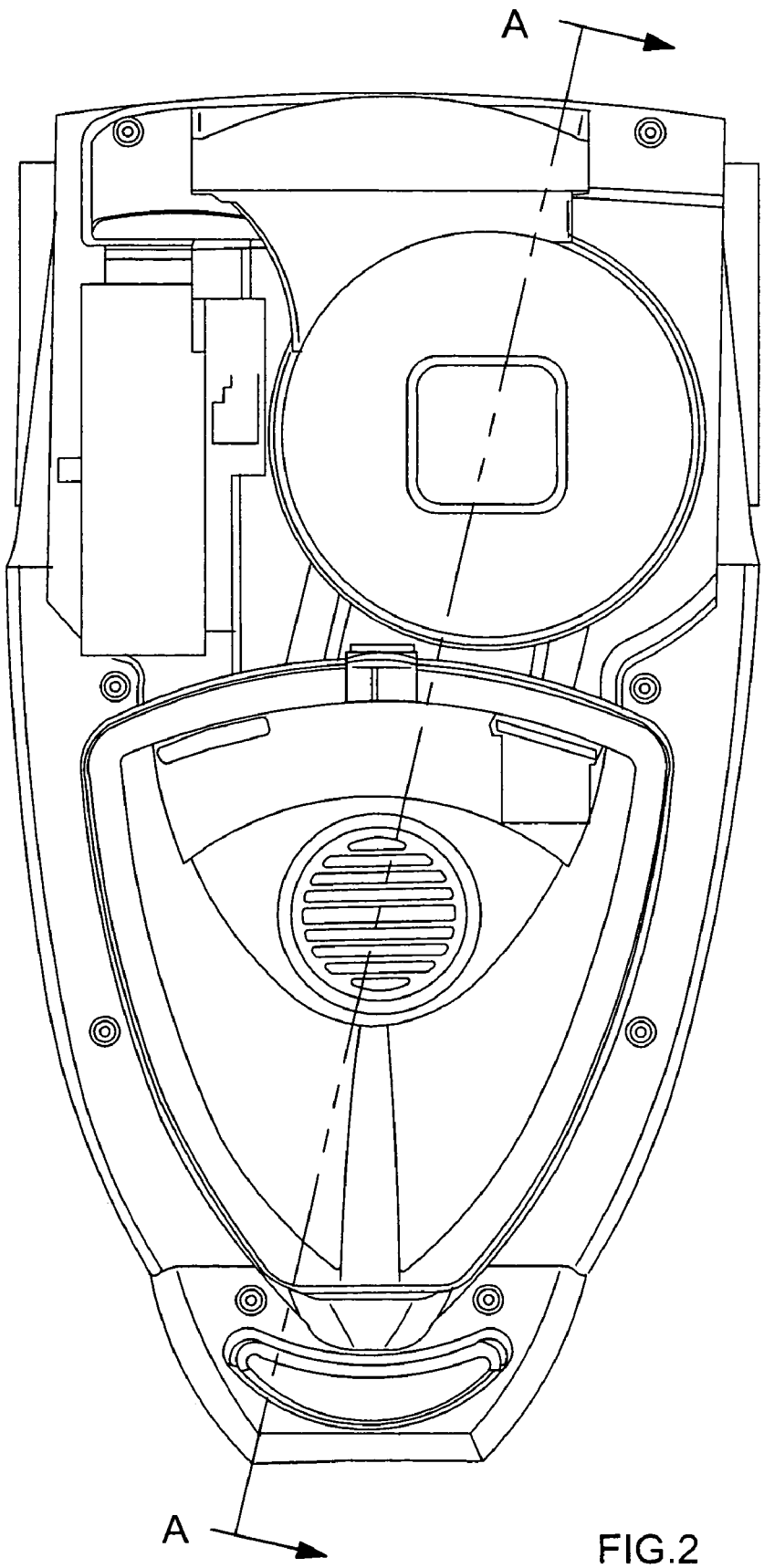
FIG. 2 is a partially cut away plan view of the vacuum cleaner housing of FIG. 1.

Referring to FIGS. 1 to 4, a cylinder type vacuum cleaner 2 has a housing 4 having a main housing part 5, a carrying handle 6 and wheels 7. A cable winder switch 8 and ON/OFF switch 10 are provided on an upper part of the housing.

The housing 4 defines an inlet 12 for connection to a flexible hose 14 (FIG. 12) at one end of the housing. A dirt collection receptacle 16 is removably attached to the housing 4 by means of a suitable latching mechanism (not shown) and defines a dirt collection chamber 18. The receptacle 16 has a central raised portion 20 for sealing engagement with a cylindrical filter element 22 formed from pleated fibrous material, such as paper or textile, covered by a breathable fabric, and is closed by a lid 24 which sealingly engages upper part 26 of filter element 22 by means of an annular seal 28, the annular seal surrounding a vent 30 in the lid 24, the function of which will be described in greater detail below. The lid 24 also has an edge 32 for gripping by a user during lifting of the lid.

The dirt collection unit 16 is held in position by the latching mechanism against an inner wall 34 of a recess integrally formed with the main part 5 of the housing 4. The raised portion 20 of the dirt collection unit 16 has a central aperture 36 cooperating with an aperture in upper wall 34 of recess 36, the raised portion 20 being surrounded by first 40 and second 42 trough regions for collecting dirt, in a manner which will be described in greater detail below.

A motor chamber 44 communicates with recess 36 via an aperture 46, and a motor 48 is mounted via sealing mounts 50 for rotation about an axis 52. A fan (not shown) is mounted coaxially with motor 48 and communicates via exhaust outlet 54 with the atmosphere. A filter cassette (not shown) containing a hepa filter is mounted in outlet 54 for filtering air expelled out of the outlet 54 by means of the fan.

The recess 36 is closed by means of closure plate 56, which is mounted to the main housing part 4, and is provided with a bypass valve 58 for allowing entry of air into recess 36 if the air pressure within recess 36 falls below a predetermined value. In this way, the main housing part 4 can be easily injection moulded, the inner wall 34 forming a recessed part of the main housing part 4. The recess 36 is then closed by means of closure plate 56 so that the recess 36 defines a duct between the outlet 38 of filter unit 22 and an inlet of the motor chamber 44.

The operation of the vacuum cleaner 2 will now be described.

Figure 3:
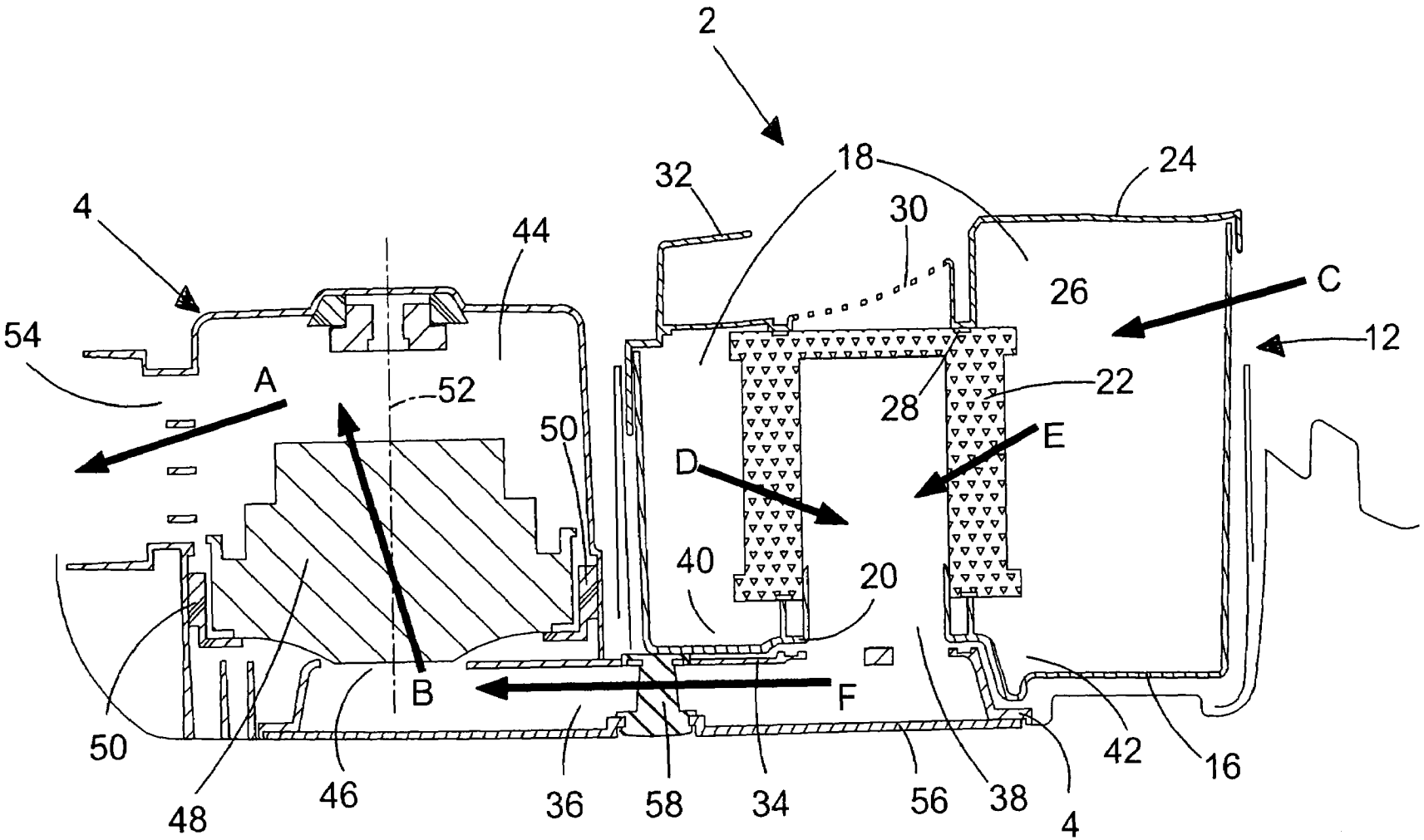
FIG. 3 is a view along the line A-A in FIG. 2.
Figure 4:
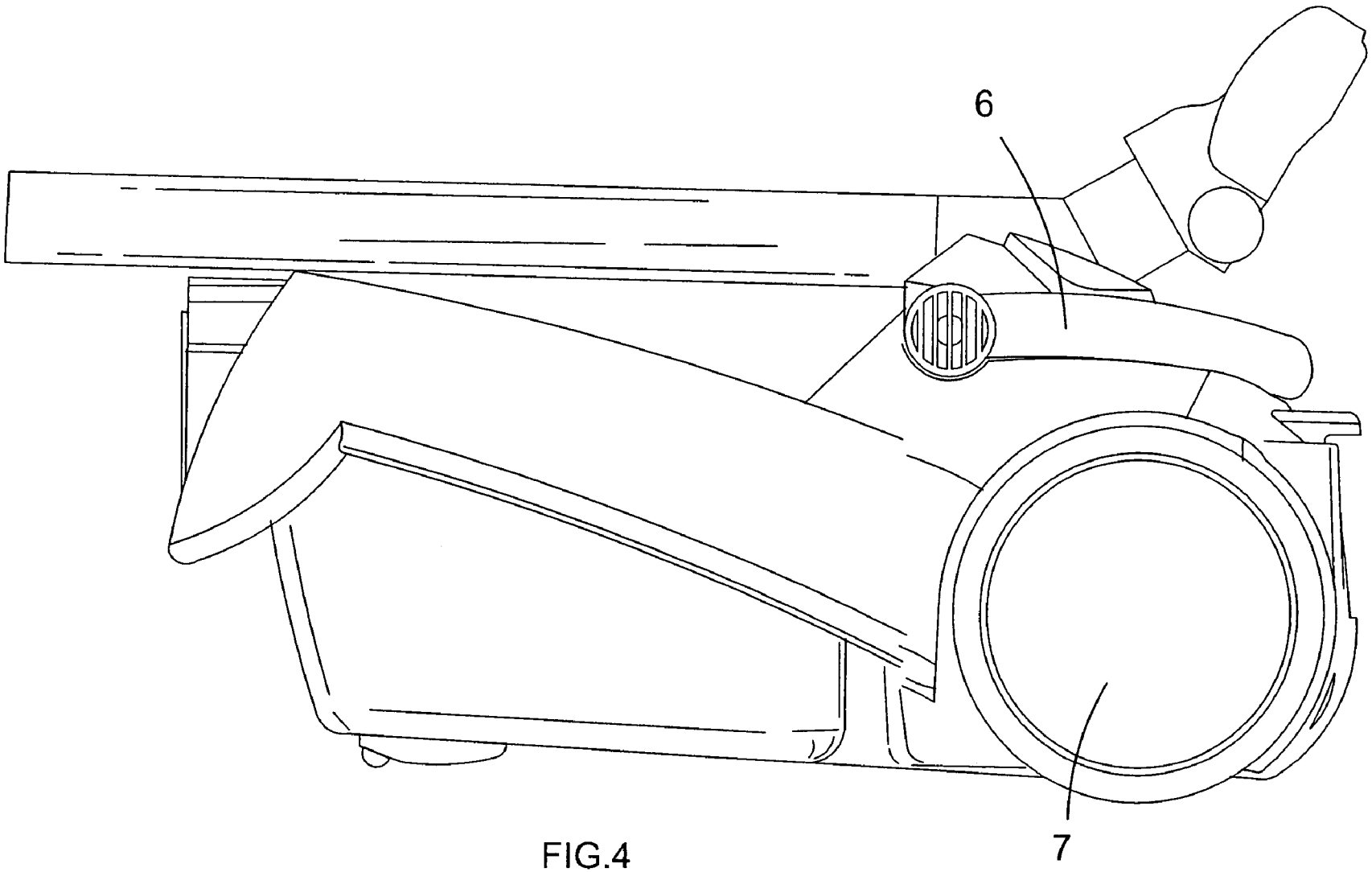
FIG. 4 is a side view of the vacuum cleaner of FIG. 1.

Actuation of motor 48 by means of ON/OFF switch 10 causes the fan to radially displace air out of outlets 54 in the direction of arrow A shown in FIG. 3. As a result, suction is caused upstream of the fan, which draws air from recess 36 generally axially into motor chamber 44 in the direction of arrow B. This in turn causes dirty air to be drawn through inlet 12 (to which a suitable accessory such as a floor cleaning head (FIG. 5) is connected by means of a flexible hose (HG. 12)), and is drawn into dirt collection chamber 18 in the direction of arrow C and then inwardly through the walls of filter unit 22 in the direction of arrows D and E. Because of annular seal 28 surrounding vent 30, the only source of air to the motor chamber 44 at negative pressure is via inlet 12.

Figure 8:
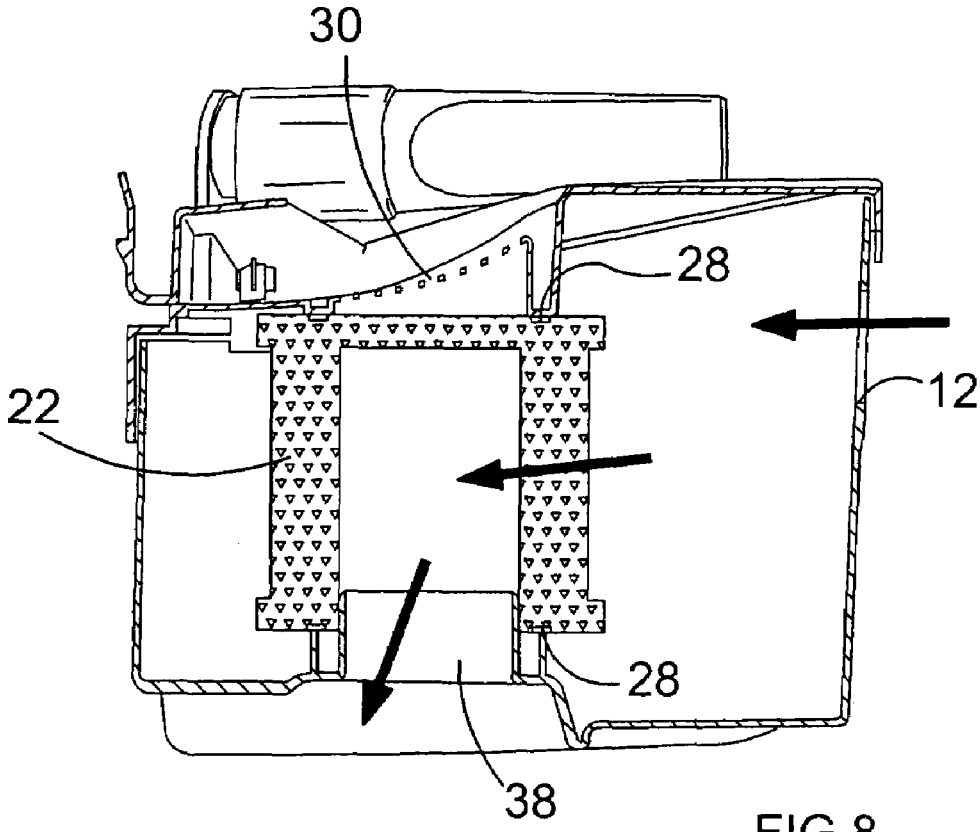
FIG. 8 is a sectional view along the line D-D in FIG. 7.

The air filtered by filter unit 22 then passes out of aperture 38 and along the duct defined by recess 36 in the direction of arrow F. If the inlet 12 should become blocked (for example as a result of an obstacle coming into contact with it) the resulting pressure difference between the interior of recess 36 and the atmosphere causes bypass valve 58 to allow air to enter the recess 36 to prevent motor 46 from overheating. The air path from the inlet 12 to the outlet 38 via the filter unit 22 is shown in more detail in FIG. 8.

Figure 10:
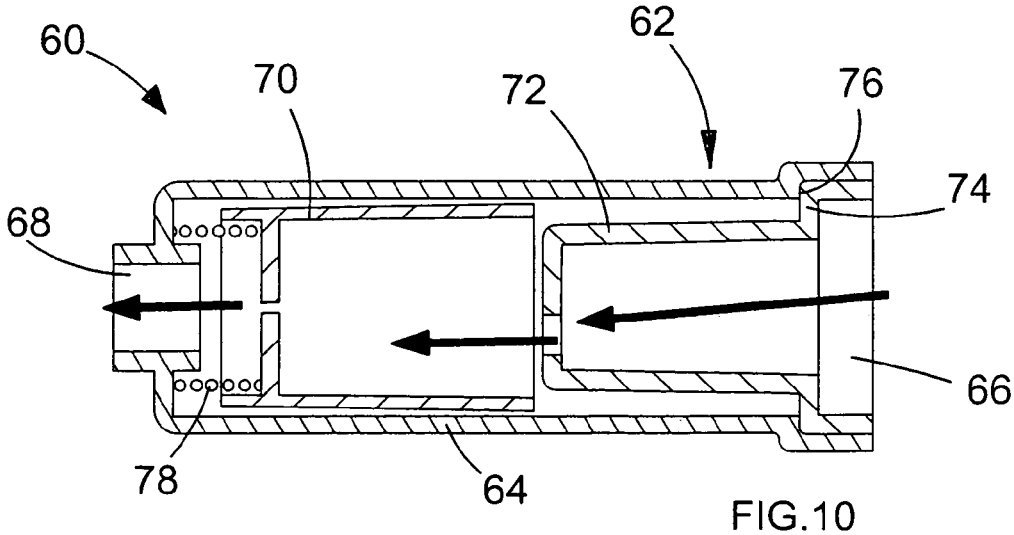
FIG. 10 is a cross-sectional view of a "filter full" indicator mechanism of the vacuum cleaner of FIG. 1.

Referring now to FIG. 10, a "filter full" indicator mechanism 60 is mounted to closure plate 56 in recess 36 at a part of the closure plate having a transparent window portion 62. The indicator mechanism 60 comprises a housing 64 having an opening 66 into which air enters from externally of the vacuum cleaner housing 4 by means of a suitable valve, which may be the by-pass valve shown in FIG. 3. The housing 64 has an outlet 68 open to the interior of recess 36, and is provided with a green perforated cover member 70 which can slide axially relative to a red perforated flag member 72, which has a flange 74 abutting a corresponding recess 76 in the housing 64. A cover member 70 is urged over the flag member 72 by means of a compression spring 78.

In normal operation of the vacuum cleaner (i.e. in the absence of blockages in the air flow path and with clean filters in the filter unit 22), the difference in air pressure between the outlet 68 and the inlet 66 is insufficient to displace the cover member 70 from the flag member 72 against the force of compression spring 78. However, as the filter unit 22 becomes blocked by dirt, the difference in pressure between the recess 36 and the atmosphere (and therefore between the outlet 68 and the inlet 66) increases, as a result of which the cover member 70 is displaced against the force of spring 78 from flag member 72, and the red coloured flag member 72 can then be seen via transparent portion 62, providing the user with a visual indication that the filter needs to be cleaned.

Figure 9:
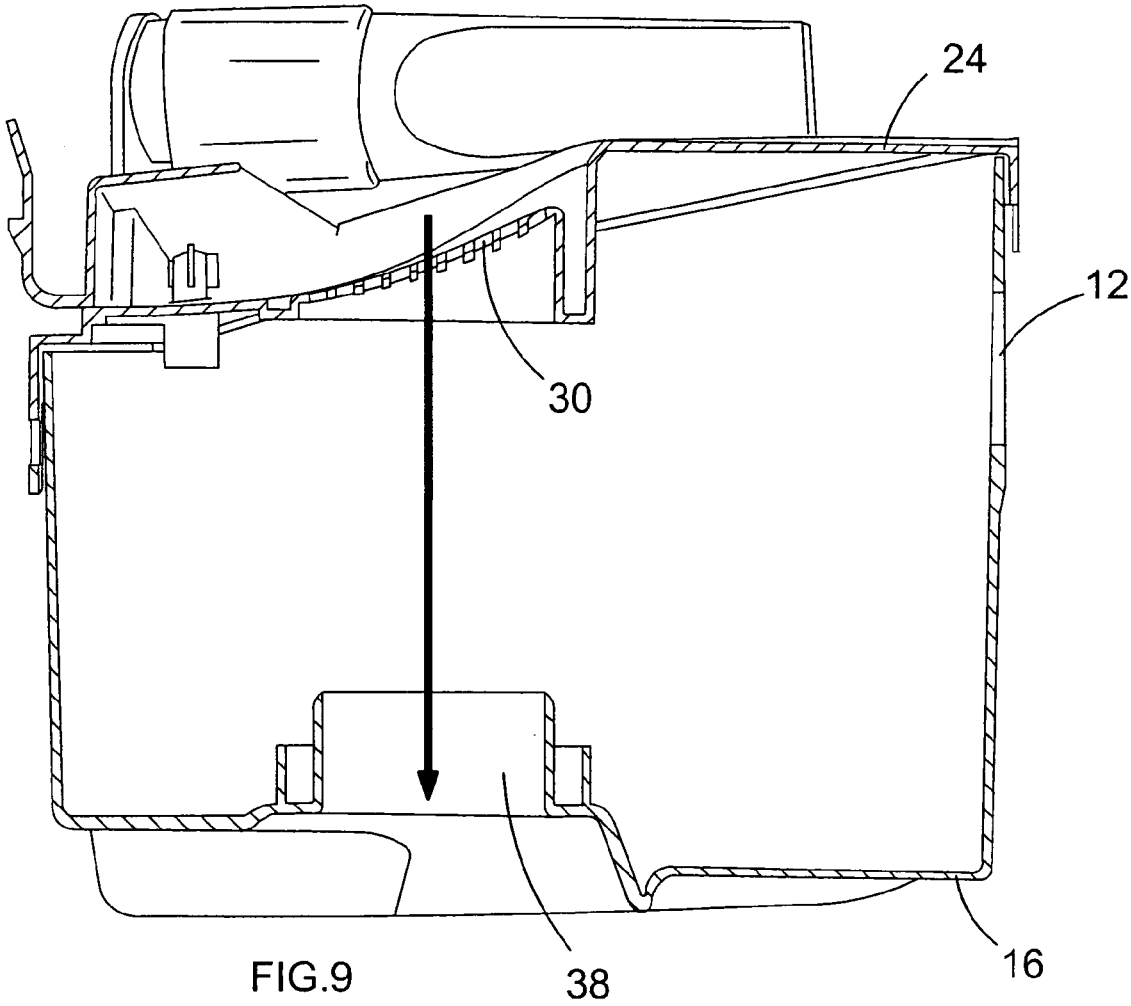
FIG. 9 is a sectional view, corresponding to FIG. 8, but with the filter element removed.

Referring back to FIG. 3, in order to clean the filter, the user lifts lid 24 by means of gripping portion 32, and then removes filter unit 22 and dirt collection chamber 16. Because the central portion of the dirt collection chamber 16 is raised, dirt trapped on the outer surface of filter unit 22 has a tendency to fall into trough regions 40, 42 and avoids falling into outlet 38. If the motor 46 should accidentally be actuated when the filter unit 22 is removed, the opening provided by opened lid 24 is nearer to outlet 38 than inlet 12, as a result of which relatively clean air from the atmosphere passes into recess 36 in preference to dirty air from the inlet 12, thus minimising the risk of the motor 46 being damaged by dirt. Even if the lid 24 should swing shut, relatively clean air passing through vent 30 still passes into duct 36 in preference to dirty air from inlet 12, in the absence of filter unit 22 blocking the path of air through the vent 30 by means of seal 28. This arrangement is shown in more detail in FIG. 9.

Figure 5:
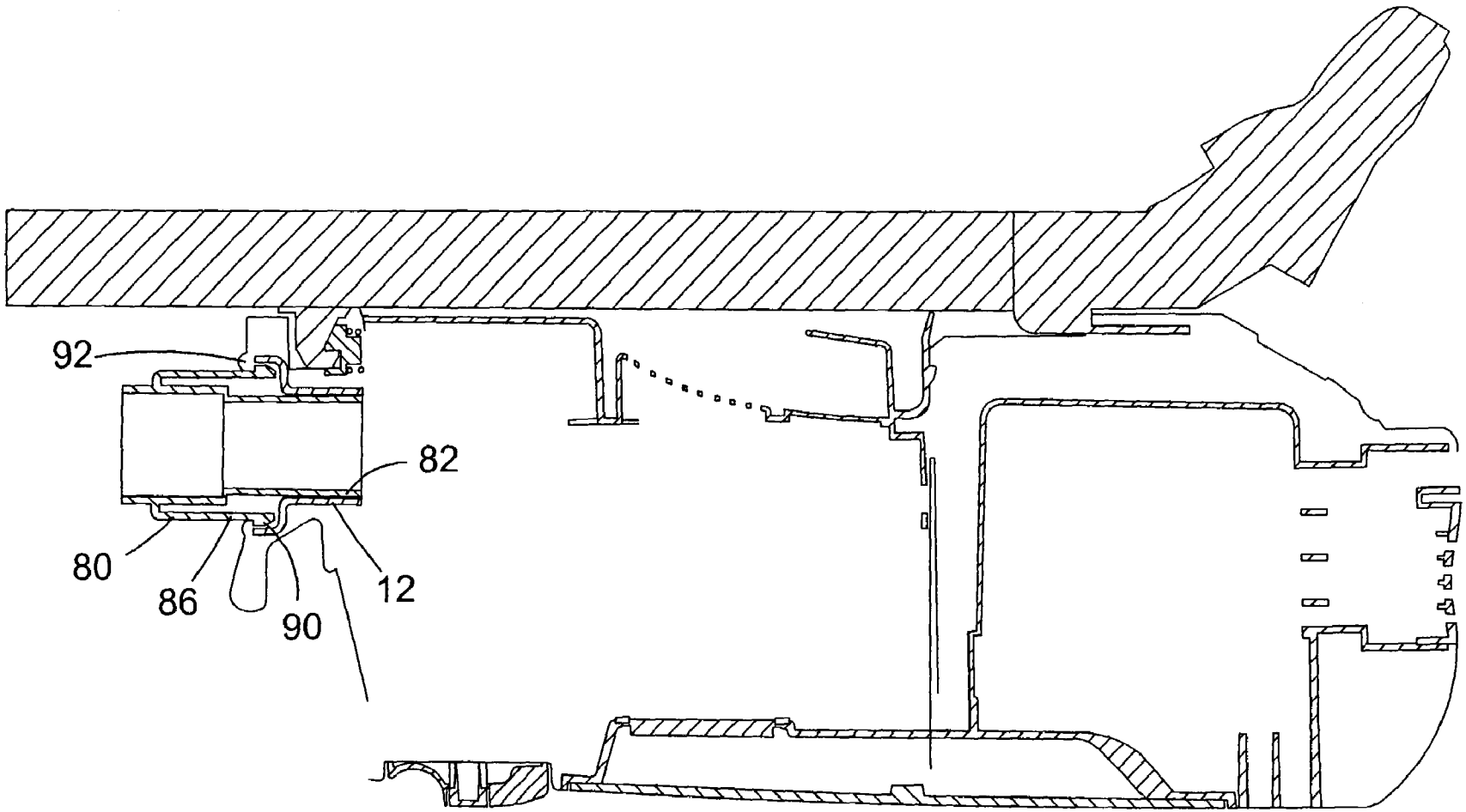
FIG. 5 is a sectional view along the line C-C in FIG. 1 with internal components of the vacuum cleaner removed.
Figure 6:
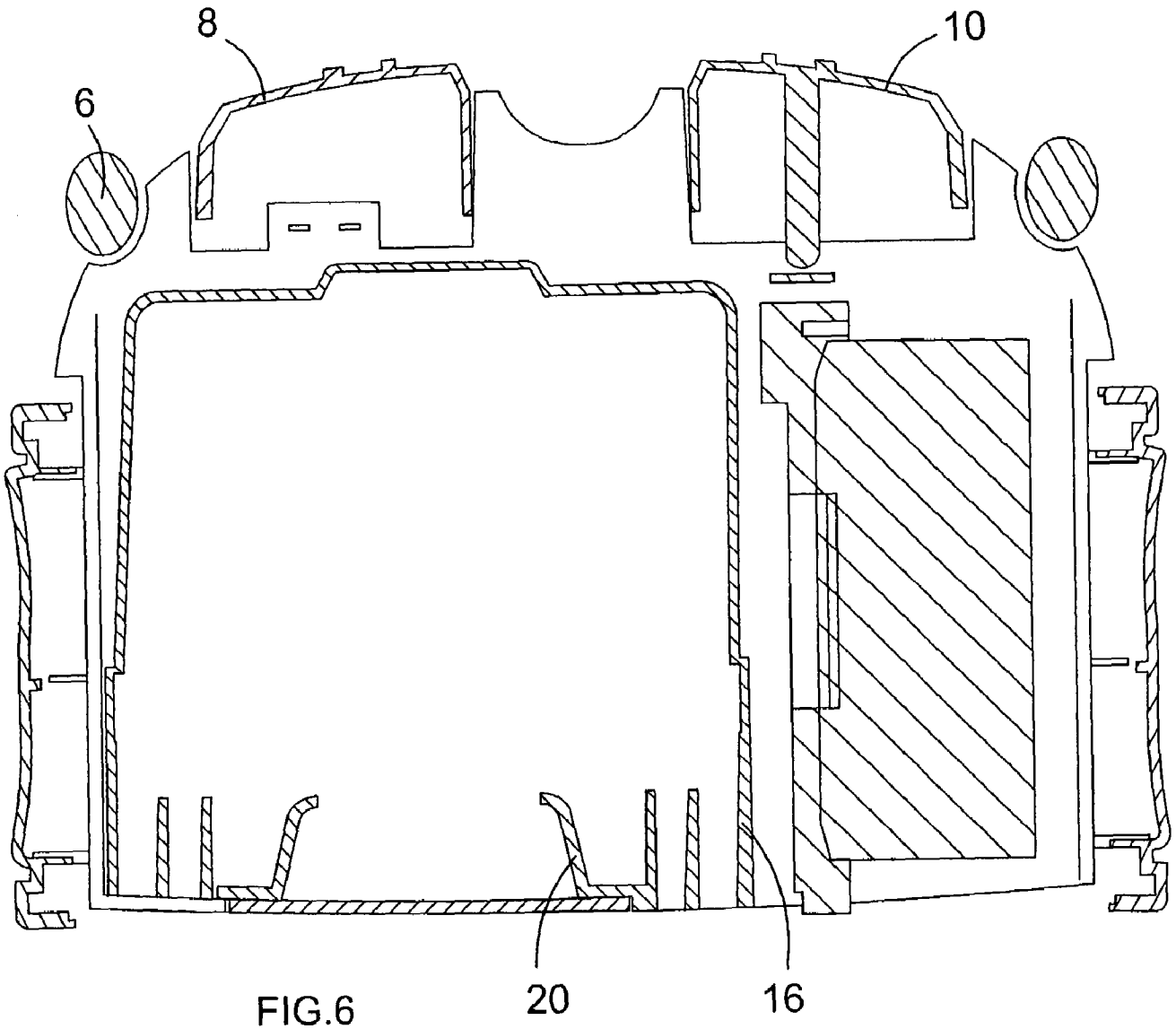
FIG. 6 is a sectional view along the line B-B in FIG. 1 with internal components of the vacuum cleaner removed.
Figure 7:
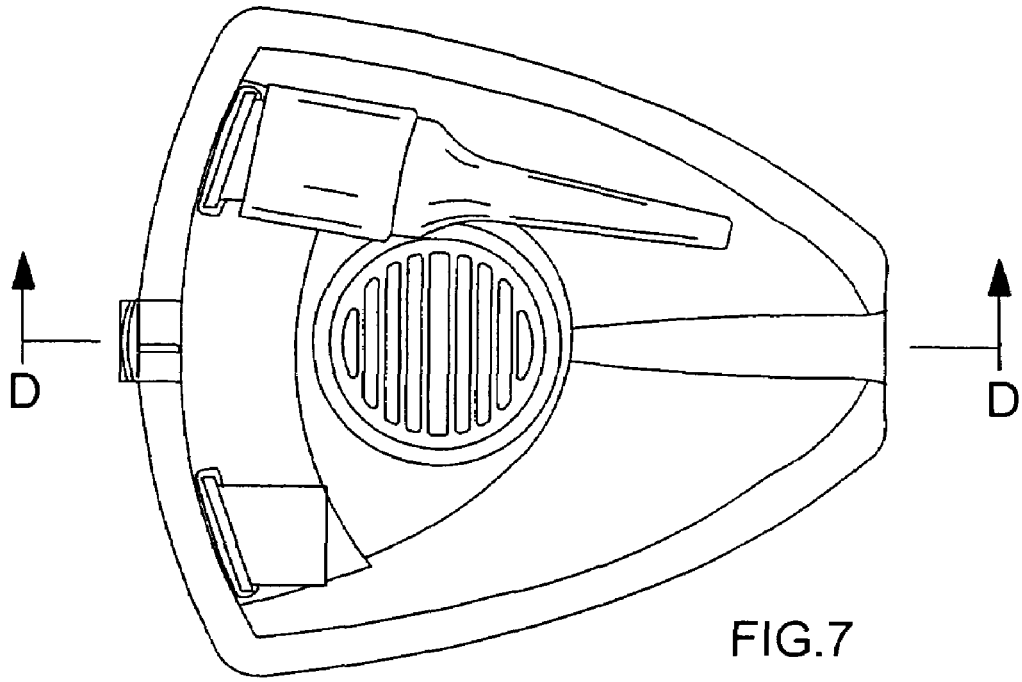
FIG. 7 is a plan view of a removable dirt container lid of the vacuum cleaner of FIG. 1.
Figure 12:
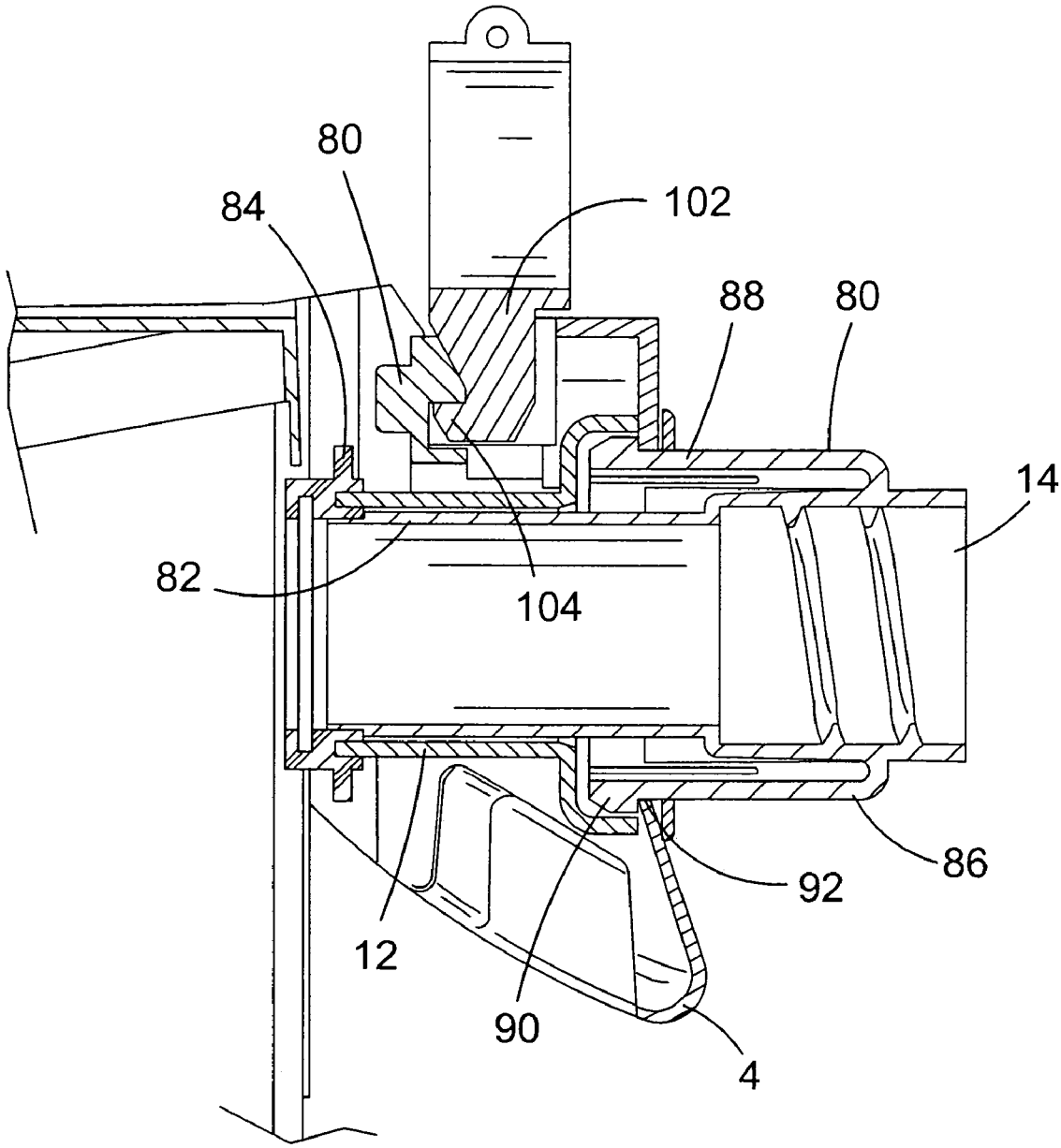
FIG. 12 is a cross-sectional view showing connection of a flexible hose to an inlet of the housing of the vacuum cleaner of FIG. 1.

Referring now to FIGS. 5 and 12, the flexible hose 14 is connected to housing inlet 12 by means of a hose connection moulding 80 having a radially inner part 82 which cooperates with a rubber seal 84 (which also forms a seal with dirt collection chamber 16) and a radially outer part 86 which is provided with resilient fingers 88 having heads 90, which locate behind edge portions 92 of the main housing part 4 to hold the connector 80 in position. In order to release the connector 80 from the housing 4, the resilient fingers 88 are pushed radially inwards until the heads 90 are released from the corresponding edge parts 92, so that the connector 80 can be axially withdrawn from the inlet 12.

Figure 11:
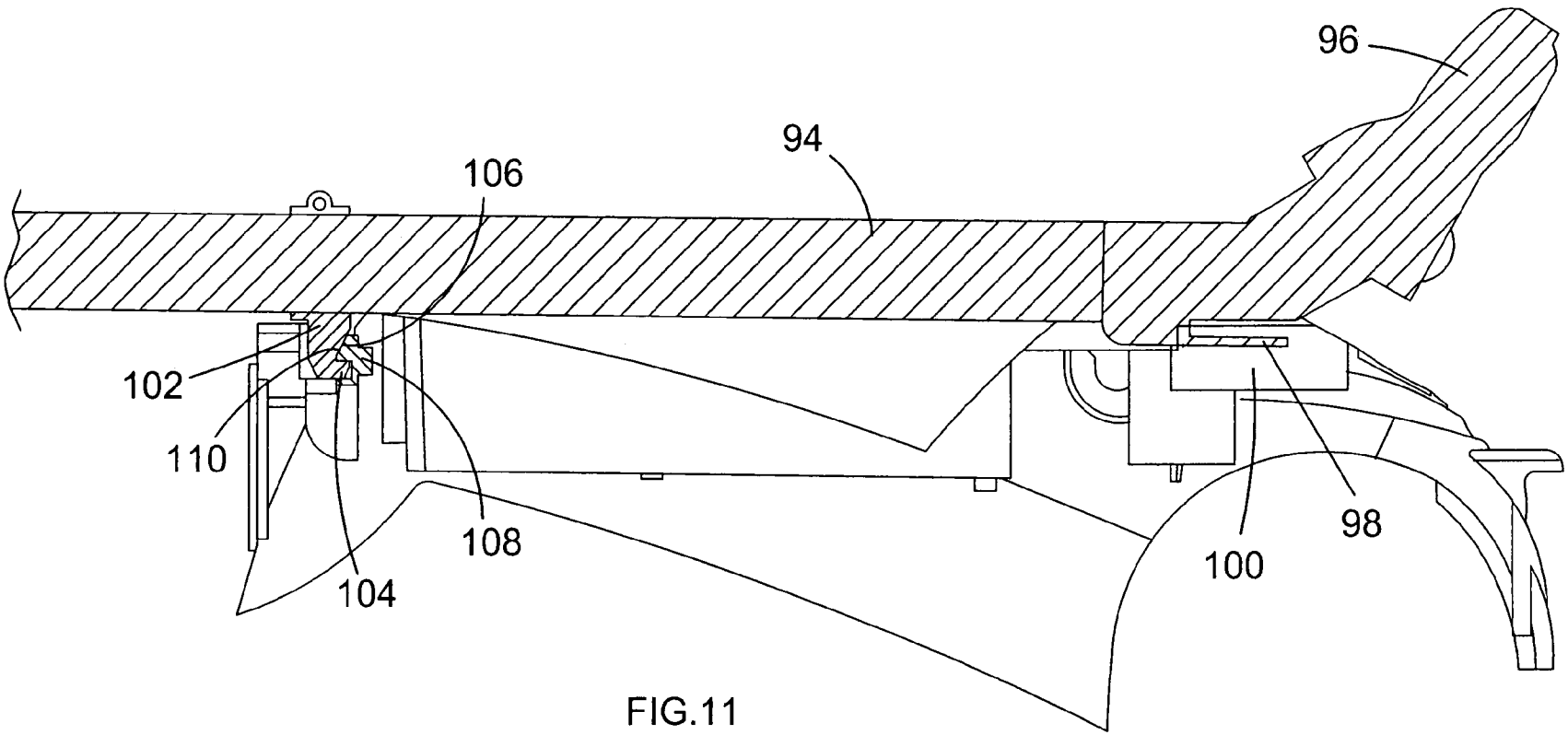
FIG. 11 is a sectional view of part of the housing of the vacuum cleaner of FIG. 1, with a floor-cleaning accessory mounted to the housing.

FIGS. 11 and 12 show a rigid tube 94 carrying a floor cleaning head 96 removably mounted to the housing 4 for storage by locating an elongate projection 98 provided on cleaning head 96 in a corresponding recess 100 on housing 4. A collar 102 surrounding tube 94 has a latching portion 104 and an inclined surface 106, and cooperates with a spring loaded latching portion 108 on housing 4 having corresponding inclined surface 110. Movement of the upper part of the tube 94 shown in FIG. 11 in the direction of arrow G causes mutual engagement of latching portion 104 and inclined surface 110, as a result of which latching portion 108 is displaced against the action of a spring (not shown) to cause latching portion 104 to be latched in position behind latching member 108 with inclined surfaces 106, 110 in contact with each other. In order to release the tube 94 from the housing 4, a release catch (not shown) is depressed to displace latching member 108 against the action of the spring so that the latching portion 104 of collar 102 can be withdrawn from the housing.

Figure 19:
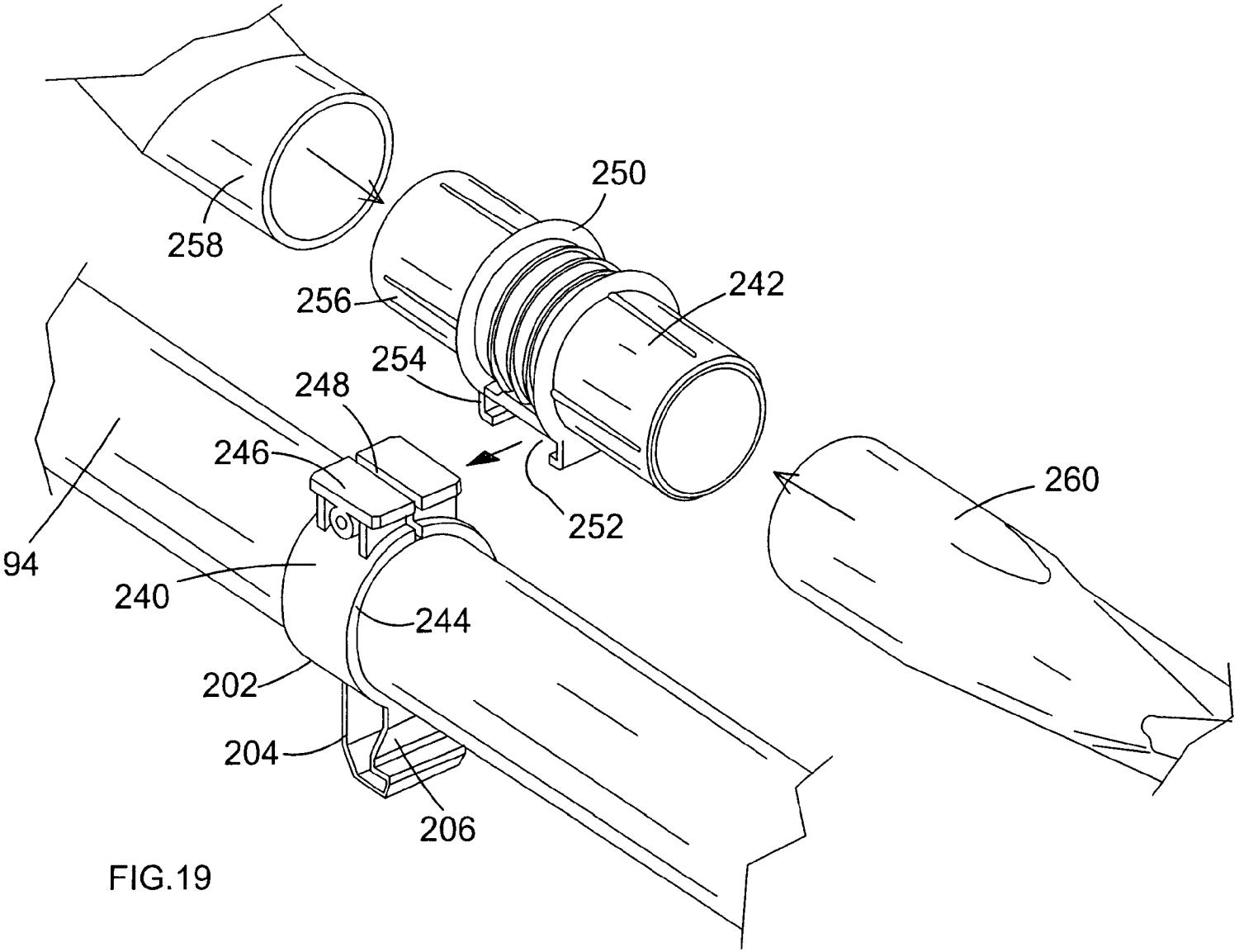
FIG. 19 is a perspective view of a device for mounting accessories to the vacuum cleaner for storage.

FIG. 19 shows a further embodiment of collar 202 for mounting to the rigid tube 94 and mounting the rigid tube 94 to the housing 4. Parts common to the embodiment of FIGS. 11 and 12 are denoted by like reference numerals but increased by 100.

The collar 202 is formed as two separate parts, a first part 240 formed as an injection moulded split ring and a tubular second part 242 which is removably attachable to the first part 240. The first part 240 has a tubular section 244 which is placed around the tube 94 and is formed on one side with latching portion 204 having inclined surface 206. The latching portion is formed as a hollow component to enable the first part 240 to be injection moulded while having sufficient strength. The first part 240 is also provided with a generally rectangular projection 246 divided by a groove 248 at the split part of tubular section 244, the projection 246 being arranged opposite the latching portion 204.

The second part 242 has an annular collar 250 having a slot 252 having an open end 254 and a closed end (not shown) for receiving the rectangular projection 246 on first part 240. The collar 250 surrounds a tubular body portion 256 having open ends for receiving an accessory 258, 260 at each end in an interference fit. The slot 252 can be mounted to the projection 246 from either direction, thus permitting left and right handed use of the collar 202, and the second part 242 is correctly located on the first part 240 by means of the closed end (not shown) of slot 252 and engagement of a projection (not shown) in slot 252 with groove 248 in projection 246. The orientation of the slot 252 relative to the body portion 256 is such that the body portion 256 and the accessories 258, 260 extend generally parallel to the longitudinal axis of tube 94. In this way, space can be particularly efficiently used for storing accessories 258, 260 on tube 94. Furthermore, by providing a collar 202 which serves the dual functions of mounting accessories 258, 260 to tube 94, and mounting tube 94 to the housing by means of latching portion 204, only a single component need by constructed, which reduces the cost of manufacturing the vacuum cleaner incorporating collar 202.

Figure 13:
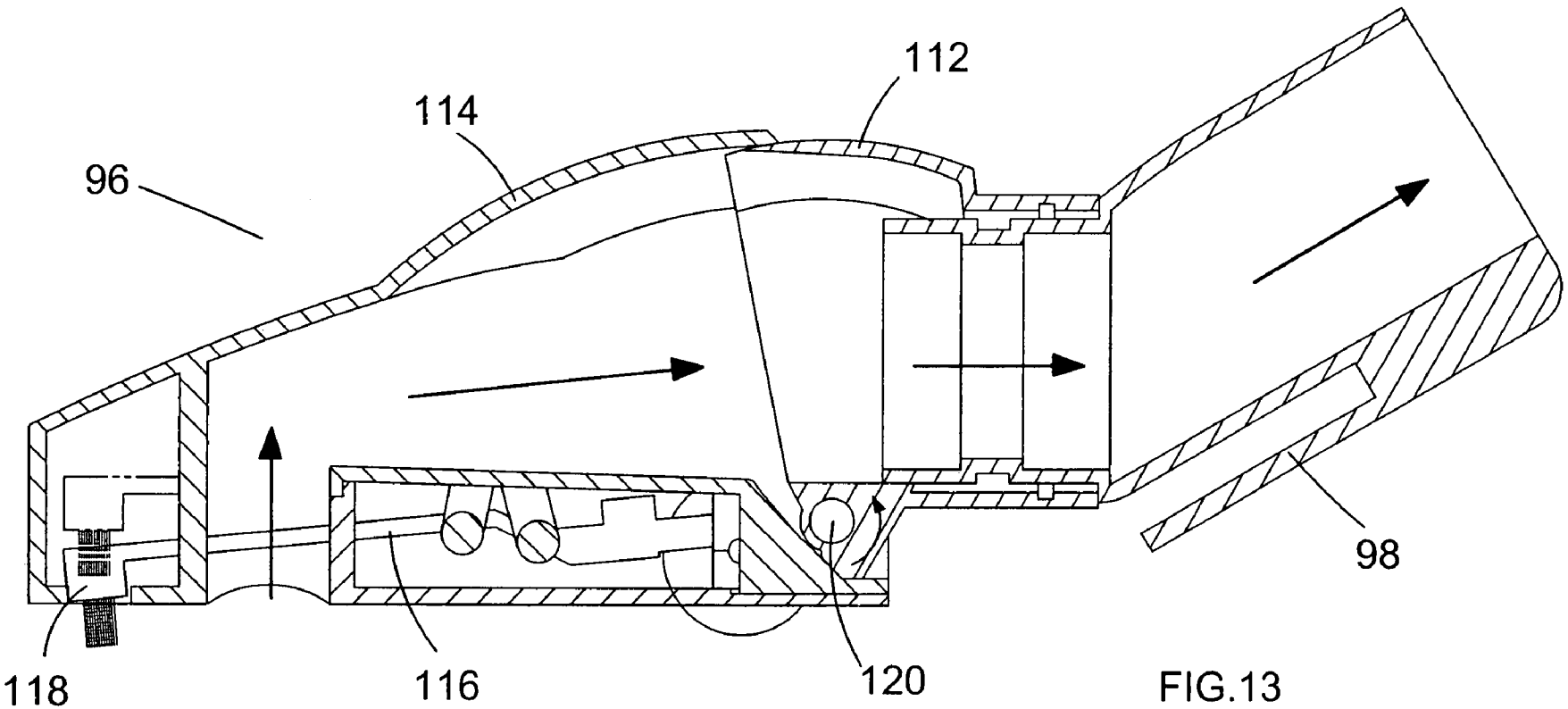
FIG. 13 is a cross-sectional view of a cleaning head of the floor-cleaning accessory of FIG. 11 with a rigid tube connected thereto in a lowered position.
Figure 14:
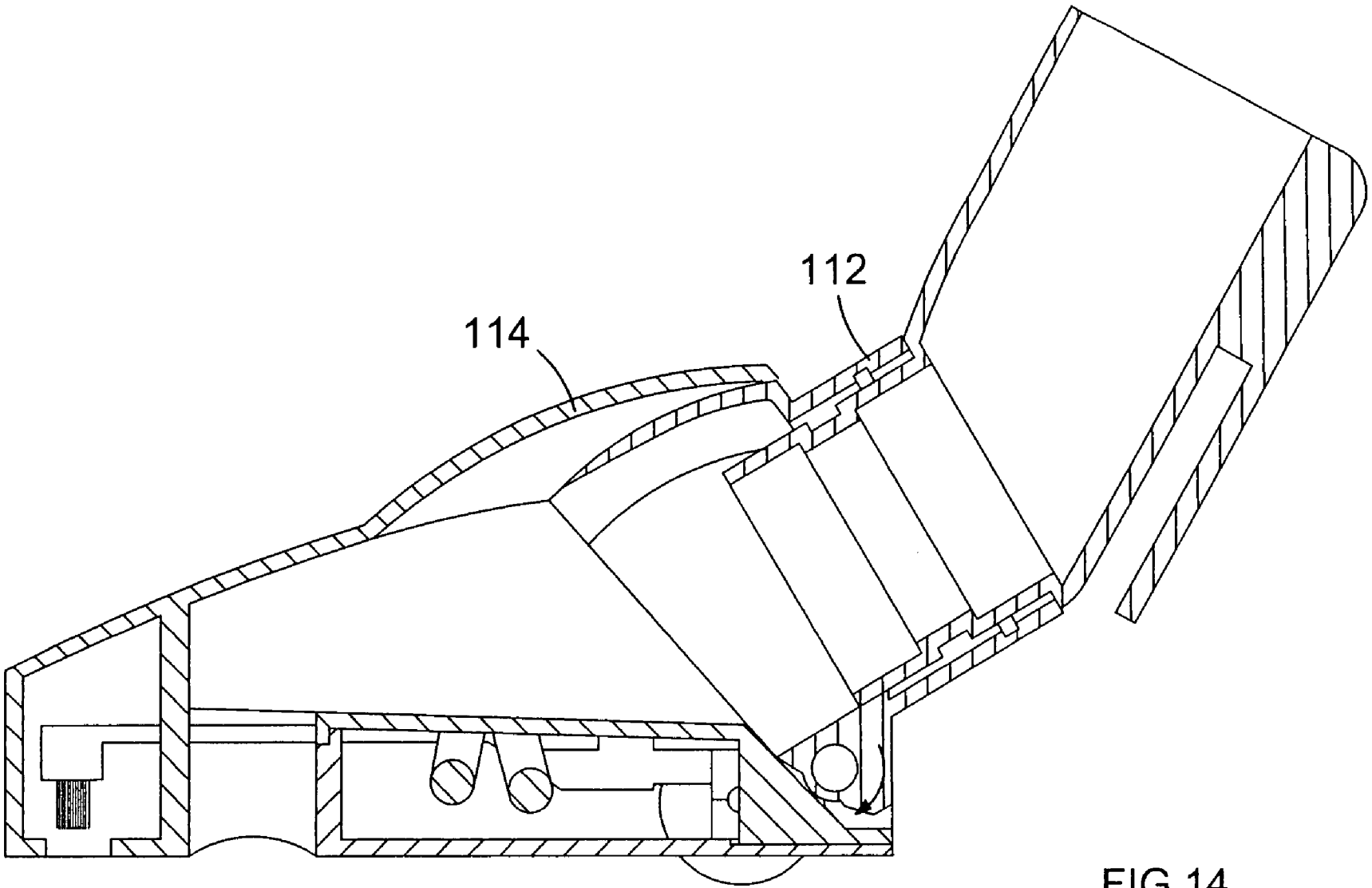
FIG. 14 is a sectional view, corresponding to FIG. 13, of the cleaning head of FIG. 13 with the rigid tube connected thereto in a raised position.
Figure 15:
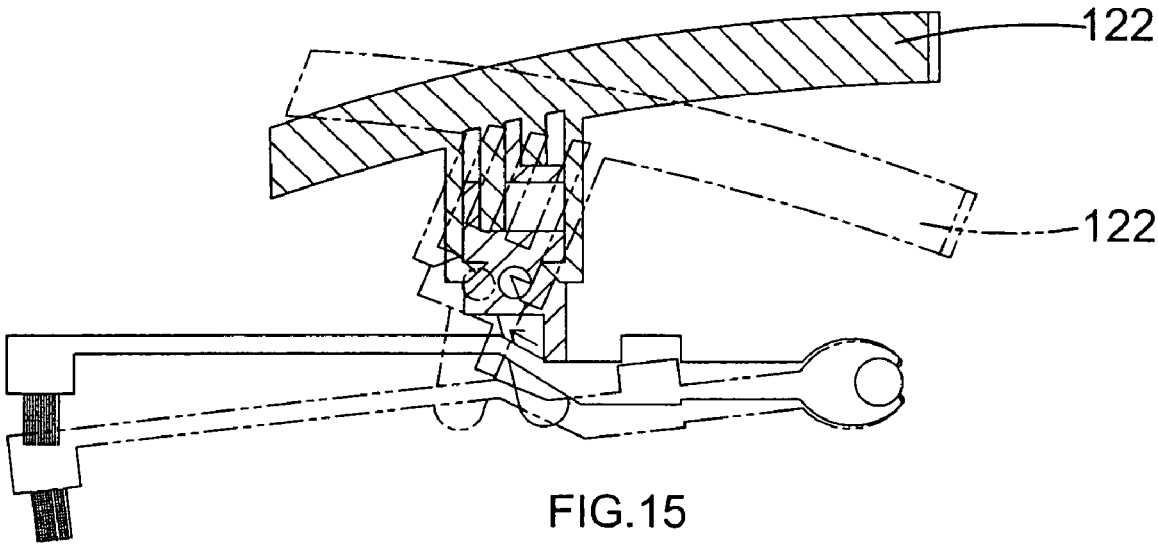
FIG. 15 is a schematic illustration of the operation of a mechanism for moving a brush plate between "brush up" and "brush down" positions in the cleaning head of FIG. 13.
Figure 18:
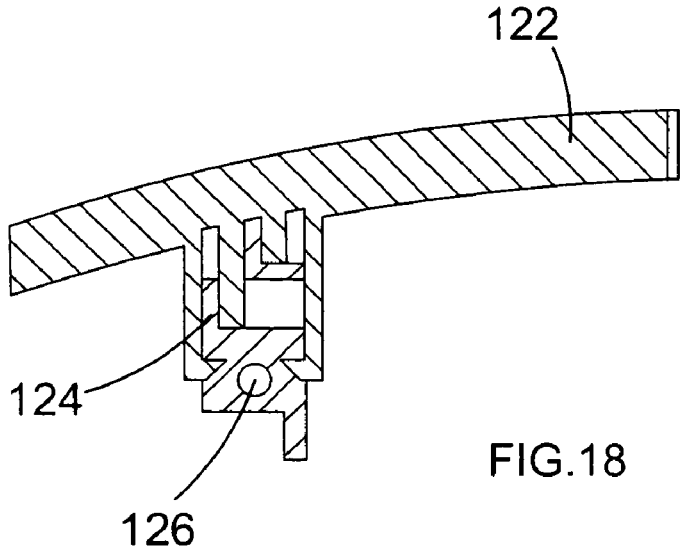
FIG. 18 is a schematic side cross-sectional view of the actuator mechanism of FIGS. 15 to 17.
Figure 16:
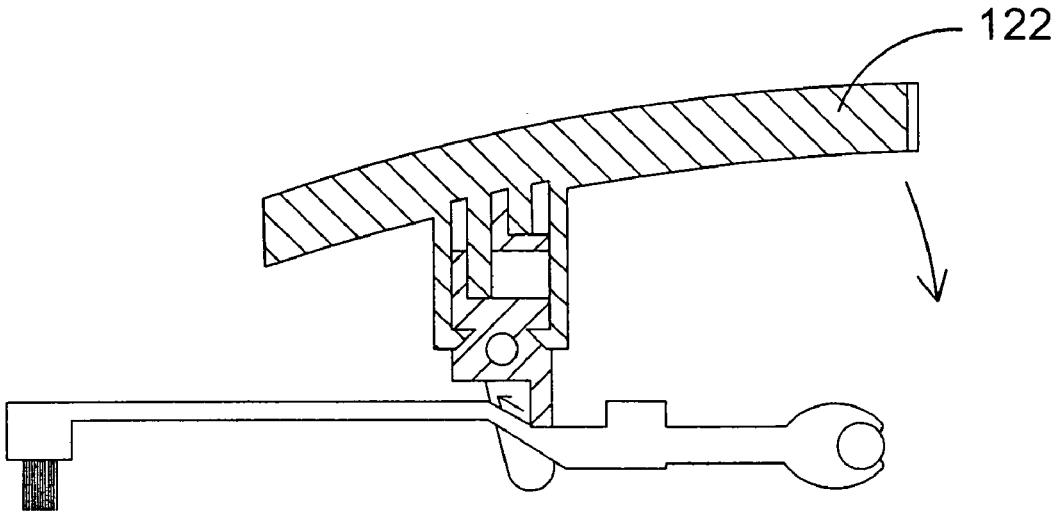
FIG. 16 is a schematic side view, corresponding to FIG. 15, of the brush plate and actuator mechanism in the "brush up" position.
Figure 17:
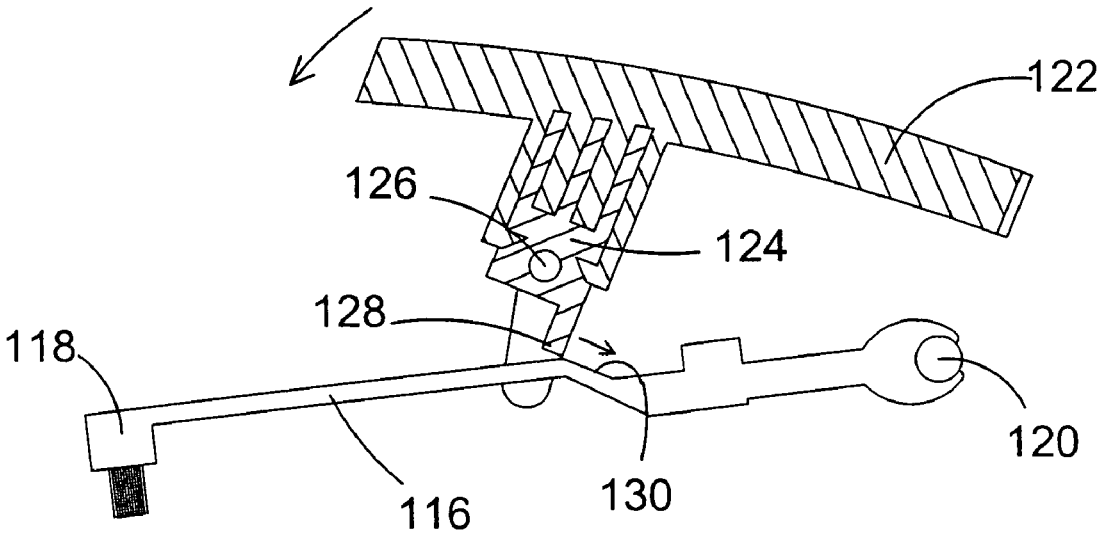
FIG. 17 is a schematic side view showing the brush plate and actuator mechanism in the "brush down" position.

FIGS. 13 to 18 show in more detail the floor cleaning head 96 shown in FIG. 11. The cleaning head 96 has a connector portion 112 pivotally mounted to a head portion 114, so that the angle of the connector portion 112 relative to the head portion 114 can be adjusted, as shown in FIGS. 13 and 14.

A brush plate 116 carries a brush member 118 and is connected to a pivot 120 located at the rear of the head portion 114. The position of the brush member 118 relative to the head portion 114 is adjusted by means of a lever 122 (FIGS. 15 to 18) carrying actuator member 124 which pivots about axis 126 to move a projection 128 on actuator member 124 along an inclined surface 130 of brush plate 116. This causes pivotal movement of brush plate 116 about pivot 120 to move the brush member 118 between "brush up" and "brush down" positions. The brush plate 116 is urged into the "brush up" and "brush down" positions by means of suitable springs (not shown).

It will be appreciated by persons skilled in the art that the above embodiment has been described by way of example only, and not in any limitative sense, and that various alterations and modifications are possible without departure from the scope of the invention as defined by the appended claims. For example, the body portion 256 of FIG. 19 may extend generally at right angles to the longitudinal axis of tube 94.

The invention claimed is:

1. A housing for a vacuum cleaner, the housing comprising:

a first housing part defining a first chamber having a first inlet for intake of air and a first outlet for exhaust of air, wherein said first chamber is adapted to accommodate filter means for removing particles larger than a predetermined size from air flowing from said first inlet to said first outlet;

a second chamber having a second inlet for intake of air and a second outlet for exhaust of air, wherein said second chamber is adapted to accommodate suction means for causing air to flow from said first inlet to said second outlet;

a recess formed in an external wall of said first housing part and connecting said first outlet to said second inlet; and at least one second housing part for closing said recess to define a duct for directing air exhausted from said first outlet to said second inlet.

2. A housing according to claims 1, wherein at least one said second housing part comprises valve means for allowing intake of air from the atmosphere into said duct if the pressure difference between said duct and the atmosphere exceeds a predetermined level.

3. A housing according to claim 1, wherein the first chamber has a trough surrounding said first outlet.

4. A housing according to claim 1, wherein the cross-sectional area of the duct in a direction transverse to the direction of airflow is greater than the total cross-sectional area of the or each said second inlet.

5. A housing according to claim 1, further comprising sealing means for sealing between the periphery of the or each said recess and the or each said second housing part.

6. A housing according to claim 1, further comprising restriction means for restricting access to at least one said second inlet.

7. A housing according to claim 6, wherein said restriction means comprises at least one grille.

* * * * *